US006250216B1

(12) United States Patent
Bornhorst

(10) Patent No.: US 6,250,216 B1
(45) Date of Patent: Jun. 26, 2001

(54) PRESS DEFLECTION CONTROLLER AND METHOD OF CONTROLLING PRESS DEFLECTION

(75) Inventor: John B. Bornhorst, New Bremen, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/272,284

(22) Filed: Mar. 19, 1999

(51) Int. Cl.[7] ..... B30B 15/28; B30B 15/14

(52) U.S. Cl. ..... 100/35; 72/455; 100/46; 100/258 A

(58) Field of Search ..... 100/35, 99, 46, 100/258 R, 258 A; 72/455, 701

(56) References Cited

U.S. PATENT DOCUMENTS

| | | | | |
|---|---|---|---|---|
| 36,276 | | 8/1862 | Cochran . | |
| 2,417,697 | * | 3/1947 | Loomis | 72/455 |
| 3,154,006 | | 10/1964 | Novak . | |
| 3,581,656 | * | 6/1971 | Pappas et al. | 72/455 |
| 3,592,131 | | 7/1971 | Otsuka et al. . | |
| 3,779,155 | | 12/1973 | Ohno . | |
| 3,858,432 | | 1/1975 | Voorhees et al. . | |
| 4,064,734 | | 12/1977 | Pahnke . | |
| 4,137,840 | | 2/1979 | Kubota . | |
| 4,148,203 | | 4/1979 | Farazandeh et al. . | |
| 4,157,066 | | 6/1979 | Pretty . | |
| 4,240,342 | | 12/1980 | Delmer . | |
| 4,274,282 | | 6/1981 | Budraitis et al. . | |
| 4,291,571 | | 9/1981 | Claussen . | |
| 4,325,298 | | 4/1982 | Delmer . | |
| 4,723,429 | | 2/1988 | Weber et al. . | |
| 4,732,032 | * | 3/1988 | Kogure | 100/46 |
| 4,887,336 | * | 12/1989 | Cann | 100/258 A |
| 5,142,769 | | 9/1992 | Gold et al. . | |
| 5,193,452 | | 3/1993 | Dieperink . | |
| 5,243,902 | | 9/1993 | Plazenet . | |
| 5,285,722 | * | 2/1994 | Schockman | 100/99 |
| 5,701,811 | | 12/1997 | Kawakami . | |

FOREIGN PATENT DOCUMENTS

| | | | | |
|---|---|---|---|---|
| 0 358 405 | | 3/1990 | (EP) . | |
| 2 235 404 | | 3/1991 | (GB) . | |
| 2 309 406 | | 7/1997 | (GB) . | |
| 59-193718 | * | 11/1984 | (JP) | 100/46 |
| WO 94/15732 | | 7/1994 | (WO) . | |

* cited by examiner

*Primary Examiner*—Stephen F. Gerrity
(74) *Attorney, Agent, or Firm*—Randall J. Knuth

(57) ABSTRACT

A mechanical press having a press deflection controller. The press includes press members which have work surfaces, such as a slide and a bed. The press deflection controller includes a tie rod which is encased in a tube. The tie rod is connected to the press member and is maintained in tension while the tube is maintained in compression. Adjusting the tension in the tie rod during press operation works to adjust deflection in the press member.

30 Claims, 3 Drawing Sheets

PRESS DEFLECTION CONTROLLER AND METHOD OF CONTROLLING PRESS DEFLECTION

BACKGROUND OF THE INVENTION

1. Field of the Invention

The present invention relates to a method and apparatus for controlling deflections in the work surfaces of a mechanical press. The method and apparatus of the current invention may be used to alter the deflection in the work surface of, for example, the slide or the bed of a mechanical press. The method and apparatus of the current invention may be employed to alter deflections prior or not prior to machining the work surface of a press member and/or during press operation.

2. Description of the Related Art

Mechanical presses, for example, stamping presses and drawing presses, comprise a frame having a crown and a bed with a slide supported within the frame for motion toward and away from the bed. Such mechanical presses are widely used for stamping and drawing operations and vary substantially in size and available tonnage depending upon the intended use.

Conventional press machines employ a tooling apparatus in the form of a die assembly to shape a workpiece, such as in a stamping or drawing operation. The die assembly particularly includes a lower die attached to the work surface of a non-moveable bed or bolster and an upper die or punch attached to the work surface of a reciprocating slide. The upper and lower dies, which are installed in opposing spaced apart relation to one another, cooperate during press machine operation to mutually engage the workpiece at respective sides thereof to thereby effect the desired forming activity.

Repeated stamping operations of a mechanical press cause deflections in portions of the press. For example, press operation causes deflections in the bed and the slide of the mechanical press. Bed and slide deflections are typically within the range of 0.002" per foot to 0.005" per foot of slide or bed width. In some production environments, such deflections will cause scrapping of stamped product which leads to increased cost and production time.

The working surfaces of the slide and the bed are typically machined to produce substantially uniform work surfaces. Having to re-machine these work surfaces is undesirable due to the necessary press down time and the wear to the work surfaces caused by additional machining. Replacing deflected work surfaces is undesirable due to the necessary press down time and substantial expense.

What is needed in the art is an apparatus and method to minimize the deflection experienced by portions of the mechanical press during press operation. What is additionally needed in the art is an apparatus and a method to monitor deflections experienced during press operation and to provide a means for automatically adjusting deflections during press operation.

SUMMARY OF THE INVENTION

The present invention provides a method and apparatus which works to eliminate deflection experienced in members of a mechanical press.

The present invention places members of a mechanical press in a prestressed condition to minimize deflection in the work surface of the press member. Further, the present invention can be utilized to monitor deflections experienced during press operation and to automatically adjust deflection during press operation.

The invention, in one form thereof, comprises a mechanical press including a press member which has a work surface that experiences deflection during press operation. A deflection controller is provided and controls the deflection of the work surface of the press member. The press member can be, for example, a slide or a bed.

The invention, in another form thereof, includes a deflection controller which comprises a tie rod that is connected to a press member and is maintained in tension. In one form of the current invention, the tie rod is connected to the work surface of the press member.

In one form of the current invention, the deflection controller comprises a tie rod which is connected by a pair of tie rod nuts to a press member. The tie rod nuts are threadedly connected to the tie rod and are selectively actuatable. When actuated the tie rod nuts increase the tension in the tie rod which correspondingly alters the deflection in the press member.

The invention, in another form thereof, comprises a deflection controller for controlling the deflection in the work surface of a press member which includes a tie rod connected to the press member and which is maintained in tension. A pair of tie rod nuts are threadedly connected to the tie rod so that when actuated the tie rod nuts increase the tension in the tie rod and correspondingly alter the deflection in the press member. A deflection measuring means which can be, for example, a strain gage or a non-contacting optical or electrical sensing means measures the deflection of the press member. A display device is provided and is communicatively connected to the deflection measuring means and displays the deflection measured by the deflection measuring means. The display device may also display a predetermined desired deflection. In this way, the deflection experienced in a press member may be compared to a predetermined desired deflection so that the tie rod nuts may be actuated when the measured deflection deviates from the predetermined desired deflection. In this way, the deflection experienced during press operation may be altered.

The invention, in another form thereof, comprises a deflection controller for controlling the deflection of the work surface of a mechanical press member. In this form, the deflection controller comprises a tie rod connected to the press member by a pair of pressure activated tie rod nut assemblies such that the tie rod is in tension. When the tie rod nut assemblies are activated, they increase the tension in the tie rod and correspondingly alter the deflection in the press member. A feedback means is connected to a deflection measuring means and to the tie rod nut assemblies for comparing a predetermined desired deflection to a measured deflection. The feedback means activates the tie rod nut assemblies when the measured deflection deviates from the predetermined desired deflection.

The invention, in another form thereof, includes pressure activated tie rod nuts. The pressure activated tie rod nuts each include a cylinder block which has a cylinder bore fit about a tie rod. A piston is threadedly engaged about the tie rod and slidingly disposed within the cylinder bore thereby forming an inner chamber. A plurality of seals are operatively located between the piston and the cylinder block to seal the inner chamber. A tie rod nut is threadedly engaged about the tie rod, engaging the piston, so that when the inner chamber is pressurized with a liquid, the increase in pressure forces the piston and tie rod nut away from the cylinder block and thereby increases the tension in the tie rod. In one form of the current invention, a tube encases the tie rod and is in compression.

The invention, in another form thereof, includes a feedback means which activates the pressure activated tie rod nut assemblies by altering the pressure within the inner chamber. The feedback means comprises: pressurizing means connected to the pressure activated tie rod nut assemblies and a comparator. The pressurizing means is activated by a control signal and changes the pressure of liquid communicated to the tie rod nut assemblies in response to the control signal. The pressurizing means can be, for example, a pump, a hydraulic cylinder, or a hydraulic power unit. The comparator has input lines for a measured deflection from a deflection measuring means and for a predetermined desired deflection. The comparator further includes an output line connected to the pump. The comparator causes a control signal to be formed on the output line on the basis of a comparison between a measured deflection and a predetermined desired deflection.

The invention, in another form thereof, comprises a press in which a crown and bed are connected together by a frame. A slide is connected within the frame for reciprocating movement in opposed relation to the bed. Both the bed and the slide have work surfaces and opposing sides which are substantially parallel to each other and perpendicular to their respective work surfaces. A first tie rod which has a first and a second end is connected to either the opposing sides of the bed or the opposing sides of the slide. In one form of the current invention, a second tie rod which has a first and a second end may be connected to the other of the opposing sides of the bed or the opposing sides of the slide. Both the first and the second tie rod may further include a tube which encases the tie rod and is in compression.

The invention, in another form thereof, comprises a method for controlling the deflection in the work surfaces of a mechanical press. This method comprises the steps of: connecting a first tie rod to one of the slide or the bed of the press and placing the first tie rod in tension.

The invention, in another form thereof, comprises a method for controlling the deflection in the work surfaces of a mechanical press. This method comprises the steps of: connecting a first tie rod to one of the slide or the bed of the press, placing the first tie rod in tension, encasing the first tie rod within a first tube, placing the first tube in compression, monitoring the deflection in the work surface of the press member to which the first tie rod is connected and altering the tension in the first tie rod and thereby correspondingly altering the compression in the first tube based upon the monitored deflection in the work surface of the press member to which the first tie rod is connected.

The invention, in another form thereof, comprises a method for controlling the deflection in the work surfaces of a mechanical press. This method comprises the steps of: connecting a first tie rod to one of the slide or the bed of the press; connecting a second tie rod to the other of the slide or the bed of the press; placing the both the first tie rod and the second tie rod in tension; encasing the both the first tie rod and the second tie rod within a first tube and a second tube, respectively; placing the first tube and the second tube in compression; monitoring the deflection in the work surfaces of the press members to which the first and second tie rods are connected and altering the tension in the first tie rod and/or the second tie rod and thereby correspondingly altering the compression in the first tube and/or the second tube based upon the monitored deflection in the work surface of the press member to which the first tie rod and/or the second tie rod is connected.

The invention, in another form thereof, comprises an apparatus for placing an object in a prestressed condition. This apparatus includes a tie rod and a tube encasing the tie rod. The tie rod and the tube encasing the tie rod are connected to the object which is to be placed in a prestressed condition such that the tie rod is in tension and the tube is in compression.

An advantage of the present invention is that the work surface of a mechanical press member may be placed in a prestressed condition prior to the machining of the work surface so that deflections experienced by the work surface may be minimized.

Another advantage of the present invention is that deflections experienced by a member of a mechanical press during press operation may be adjusted without having to re-machine the work surface or disassemble the mechanical press.

Yet another advantage of the present invention is that deflections may be automatically sensed and eliminated during press operation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
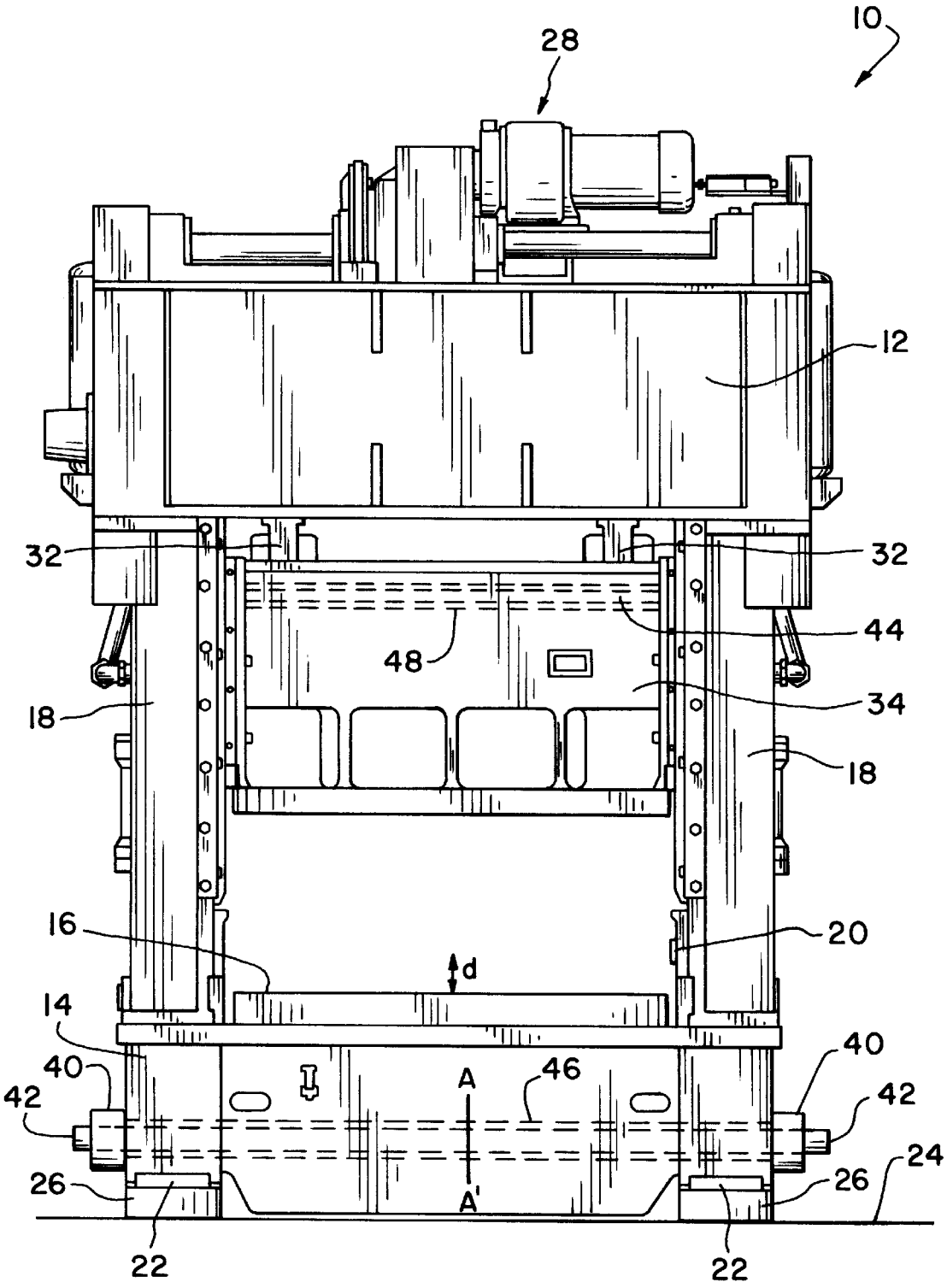
FIG. 1 is a front elevational view of a mechanical press incorporating the deflection controller of the present invention.

Referring now to FIG. 1, mechanical press 10 comprises a crown 12, a bed 14 having a bolster 16 connected thereto and uprights 18 connecting crown 12 with bed 14. Uprights 18 are connected to or integral with the underside of crown 12 and the upper side of bed 14. Tie rods (not shown) extend through crown 12, uprights 18 and bed 14 and are attached on each end with tie rod nuts (not shown). Leg members 22 are formed as an extension of bed 14 and are generally mounted on the shop floor 24 by means of shock absorbing pads 26.

A drive mechanism, such as a press drive motor 28, is attached to crown 12 of the press and connected by a clutch/brake mechanism (not shown) to a crankshaft (also not shown) to which connecting rods 32 are attached. A slide 34 is operatively connected to connecting rods 32. During operation, drive motor 28 rotates the crankshaft which operates eccentrically connected connecting rods 32 to cause slide 20 to reciprocate in rectilinear fashion toward and away from bed 14.

Figure 2:
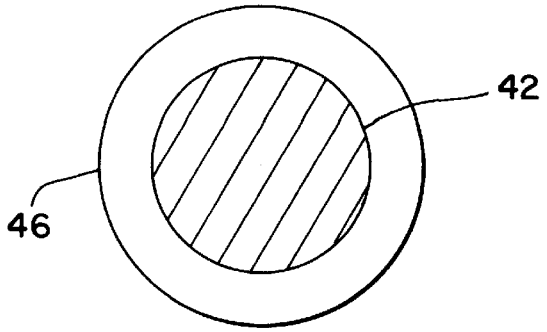
FIG. 2 is a cross sectional view taken along lines A–A' in FIG. 1 to illustrate the tie rod/tube combination in accordance with an embodiment of the present invention.

FIG. 2 illustrates a cross section of first tie rod 42 and first tube 46. Referring to FIG. 1, first tie rod 42 is connected to bed 14 by pressure activated tie rod nuts 40. First tube 46 encases first tie rod 42. Second tie rod 44 is connected to slide 34 by tie rod nuts (not shown). Second tube 48 encases second tie rod 44.

Press deflection is controlled by first measuring the deflection of a press member, such as bed 14. Deflection measuring means 20, for example, a non-contacting optical or electrical sensing means, or a strain gage is utilized to measure deflection of bed 14 during press operation. Deflection may similarly be measured in slide 34.

Figure 3:
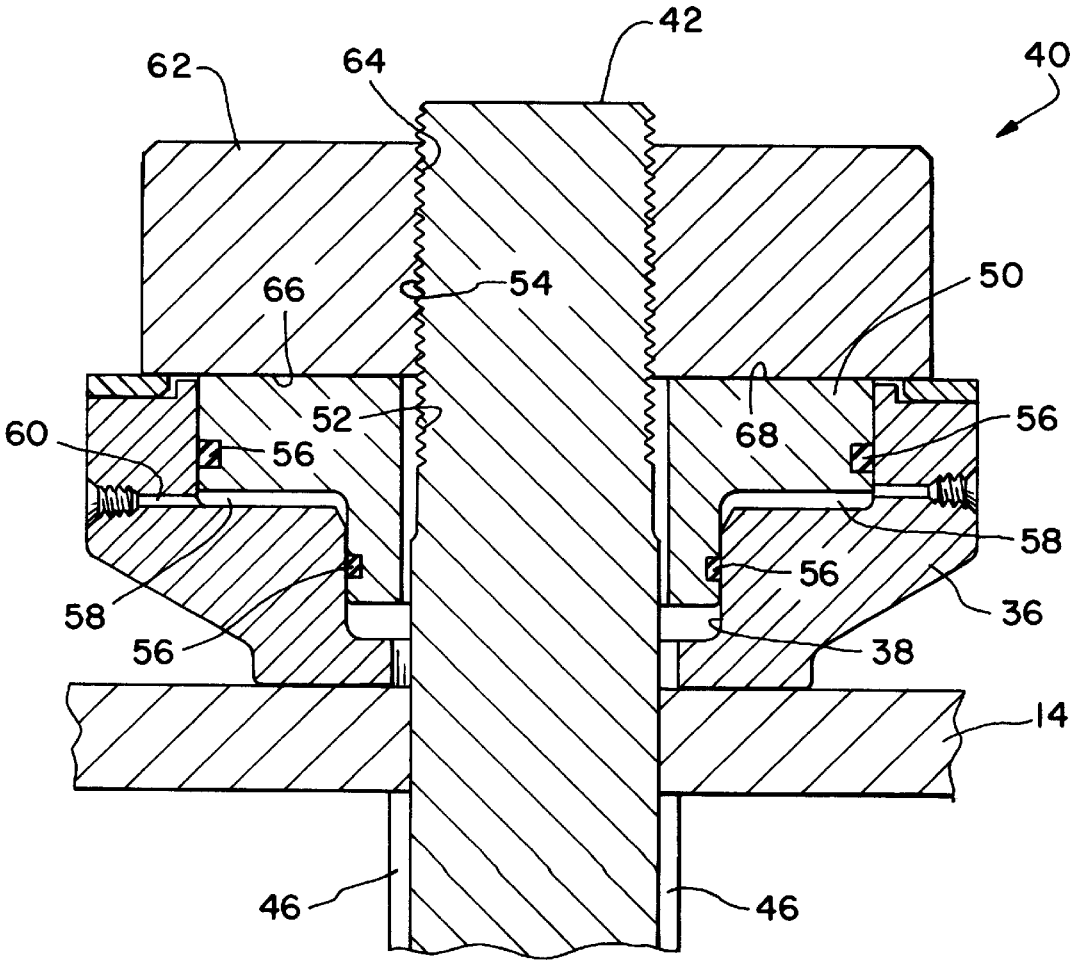
FIG. 3 is an enlarged sectional view of a pressure activated tie rod nut assembly of the present invention.

FIG. 3 illustrates a pressure activated tie rod nut 40 of the present invention. Pressure activated tie rod nut 40 comprises an annular cylinder 36 mounted upon bed 14 and about first tie rod 42. Annular cylinder 36 includes an annular bore 38 about first tie rod 42 into which an annular piston 50 is slidingly interfit. Annular piston 50 includes an annular threaded bore 52 which is threadedly engaged on threads 54 of first tie rod 42. Annular piston 50 sealingly interfits within annular bore 38 by means of seals 56. Seals 56 seal between annular piston 50 and annular cylinder 36 defining a chamber 58. Chamber 58 is connected to an oil inlet 60 that is constructed through annular cylinder 36. Annular piston 50 slides within annular cylinder 36 based on the pressure of oil injected through oil inlet 60.

On annular piston 50 and first tie rod 42 is threaded a tie rod nut 62. Tie rod nut 62 includes an annular bore having threads 64 that engage threads 54 of first tie rod 42. The bottom surface 66 of tie rod nut 62 engages the top surface 68 of annular piston 50.

Figure 4:
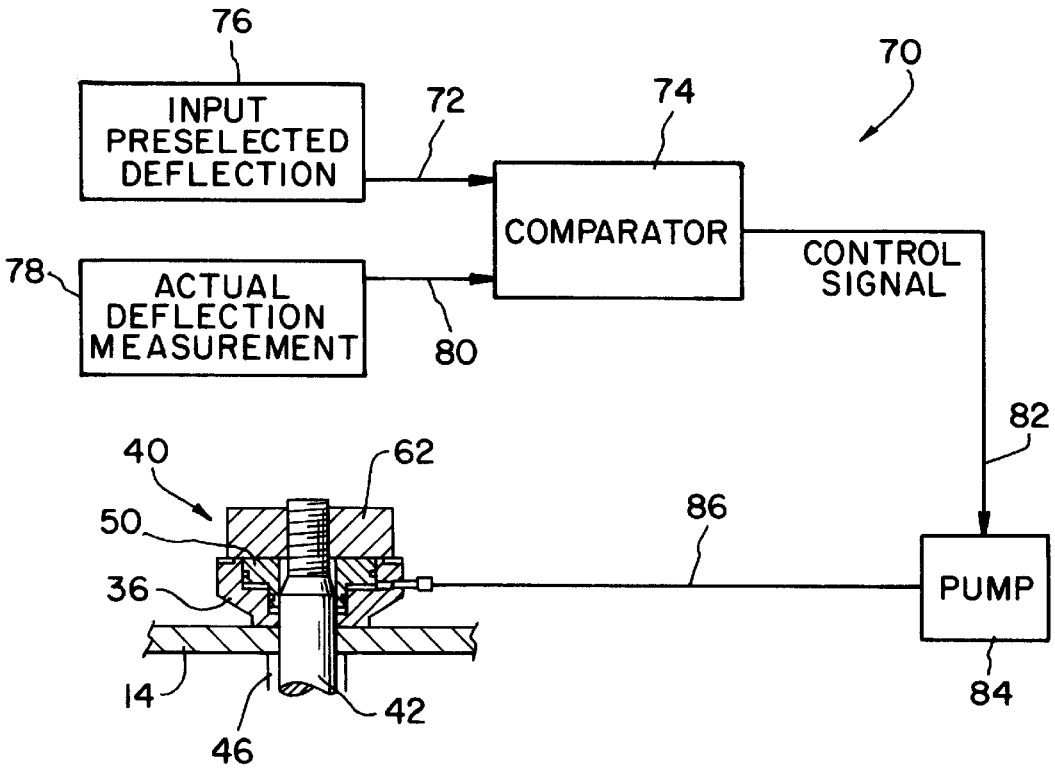
FIG. 4 is a schematic of the feedback means of the present invention.

As illustrated in FIG. 4, automatic control of deflection is maintained by control feedback means 70. The press operator may choose differing values for preselected deflection 76 including values corresponding to a bowed configuration of the press member. Preselected deflection 76 is communicated along communication line 72 to comparator 74. Comparator 74 can be, for example, a microprocessor. Alternatively, comparator 74 may be constructed from a programmable logic controller as is known in the art. Comparator 74 receives input signals and provides output or control signals as a function of its input.

Deflection measuring means 20 (FIG. 1) transmits an actual deflection measurement 78 (FIG. 4) through communication line 80 to comparator 74 during press operation. Comparator 74 compares input preselected deflection 76 to actual deflection measurement 78 and forms a control signal based upon this comparison. The control signal is communicated along communication line 82 to a pressurizing means such as pump 84. A hydraulic pump or a hydraulic power unit may also be utilized as the pressurizing means. Pump 84 communicates pressurized fluid along fluid line 86 to pressure activated tie rod nut 40. The result of the comparison between preselected deflection 76 and actual deflection measurement 78 causes comparator 74 to vary the control signal on communication line 82 to pump 84 which then alters the pressure to the pressure activated tie rod nut(s) 40. Tension in first tie rod 42 (FIG. 1) is thus controlled by altering the pressure within chamber 58 in one or both of pressure activated tie rod nut(s) 40.

Figure 5:
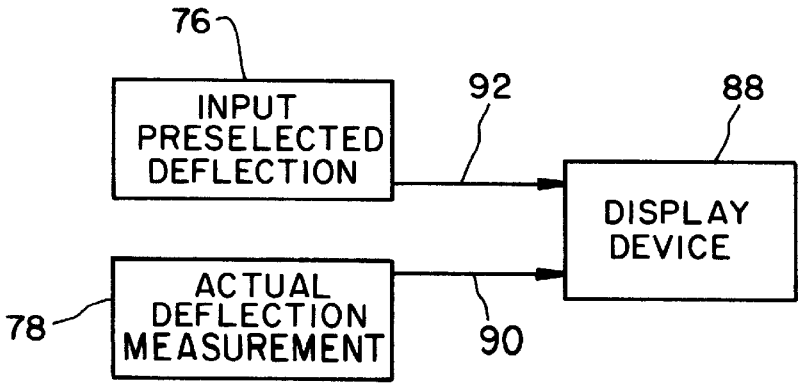
FIG. 5 is a schematic of the display means of the present invention.

FIG. 5 illustrates an alternate embodiment of the present invention which utilizes display device 88. Display device 88 is communicatively connected to deflection measuring means 20. Actual deflection measurement 78 is communicated along communication line 90 to display device 88. Input preselected deflection 76 is communicated along communication line 92 to display device 88. During press operation, a press operator can monitor display device 88 to determine if actual deflection measurement 80 is outside an acceptable range, or deviates from input preselected deflection 76 by an unacceptable amount. The press operator may then manually actuate the tie rod nuts, or signal the pressurizing means to actuate the press activated tie rod nut assemblies depending upon which type of tie rod nut is utilized.

Alternatively, the tie rod may terminate in conventional (one piece) tie rod nuts. In this case, the tie rod may be placed into tension and thereby prestressed prior to press operation or slide or bed surface milling. The work surface may thereby be bowed by the prestressed, thereby being prepared for possible deflection during press operation.

In the embodiment illustrated in FIG. 4, preselected deflection 76 is communicated along communication line 72 to comparator 74. During press operation, deflection measuring means 20 continually monitors the deflection in a press member, for example, the deflection (d) in the bed. Deflection measuring means 20 communicates actual deflection measurement 78 along communication line 80 to comparator 74. Comparator 74 varies the control signal on communication line 82 to pump 84 which then alters the pressure in the pressure activated tie rod nut(s) 40. As the pressure in the pressure activated tie rod nuts 40 is increased, the tension in first tie rod 42 increases and adjusts deflection (d). In this way, deflections experienced during press operation are constantly monitored and adjustments resulting in the minimization of deflection are constantly made.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a press member having a work surface, said work surface experiencing deflection during press operation; and a deflection controller for controlling the deflection of said work surface, said deflection controller having a tie rod connected to said press member, said tie rod being in tension.

2. The press as recited in claim 1, wherein said press member comprises:

a slide.

3. The press as recited in claim 1, wherein said press member comprises:

a bed.

4. The press as recited in claim 1, wherein said deflection controller comprises:

a tie rod connected to a portion of said press member comprising said work surface, said tie rod being in tension.

5. The press as recited in claim 1, wherein said deflection controller further comprises:

a pair of tie rod nuts threadedly connected to said tie rod, said tie rod nuts being selectively actuatable, whereby actuation of said tie rod nuts increases the tension in said tie rod and correspondingly alters the deflection in said press member.

6. The press as recited in claim 5, further comprising:

a deflection measuring means for measuring the deflection of said press member; and a display device for displaying the deflection measured by said measuring means, said display communicatively connected to said deflection measuring means, whereby the deflection measured by said measuring means can be compared to a predetermined desired deflection so that said tie rod nuts may be actuated when the measured deflection deviates from the predetermined deflection, thereby increasing the tension in said tie rod and correspondingly altering the deflection of said press member.

7. The press as recited in claim 1, wherein said deflection controller further comprises:

a pair of pressure activated tie rod nut assemblies attached to said tie rod so that when activated, said nut assemblies increase the tension in said tie rod and correspondingly alter the deflection in said press member. rod and correspondingly alters the deflection in said press member.

8. The press as recited in claim 7, wherein said tie rod nut assemblies comprise:

a cylinder block having a cylinder bore fit about said tie rod;

a piston threadedly engaged about said tie rod and slidably disposed within said cylinder bore thereby forming an inner chamber, said inner chamber pressurized with a liquid;

a tie rod nut threadedly engaged about said tie rod and engaging said piston; and a plurality of seals operatively located between said piston and said cylinder block.

9. The press as recited in claim 8, further comprising:

a deflection measuring means for measuring the deflection of said press member; and feedback means connected to said deflection measuring means and said tie rod nut assemblies for comparing a predetermined desired deflection to the deflection measured by said measuring means and pressure activating said tie rod nut assemblies when the measured deflection deviates from the predetermined deflection, whereby deflection is controlled.

10. The press of claim 9 in which said feedback means controls the deflection of said press member by altering the pressure within said inner chamber.

11. The press of claim 10 in which said feedback means comprises:

a pressurizing means connected to said tie rod nut assemblies and activated by a control signal for changing the pressure of liquid communicated to said tie rod assemblies; and comparator means having input lines for a measured deflection from said deflection measuring means and a predetermined desired deflection, said comparator means including a signal output line connected to said pressurizing means, said comparator means causing a control signal to be formed on said output line on the basis of a comparison between a measured deflection and a predetermined desired deflection.

12. The press as recited in claim 1, further comprising:

a tube encasing said tie rod, said tube being in compression.

13. A press comprising:

a crown;

a frame connected to said crown;

a bed connected to said frame, said bed having a bed work surface, said bed having opposing sides substantially parallel to each other and perpendicular to said bed work surface;

a slide connected with said frame for reciprocating movement in opposed relation to said bed, said slide having a slide work surface, said slide having opposing sides substantially parallel to each other and perpendicular to said slide work surface; and a first tie rod having a first end and a second end, each of said first end and said second end of said first tie rod connected to one of said opposing sides of said bed or said opposing sides of said slide.

14. The press as recited in claim 13, further comprising:

a second tie rod having a first end and a second end, each of said first end and said second end of said second tie rod connected to the other of said opposing sides of said bed or said opposing sides of said slide.

15. The press as recited in claim 14, further comprising:

a first tube encasing said first tie rod, said first tube being in compression; and a second tube encasing said second tie rod, said second tube being in compression.

16. A method of controlling the deflection in the work surfaces of a mechanical press having a slide and a bed, said method comprising the steps of:

connecting a first tie rod to one press member including only one of the slide or the bed of the press; and placing the first tie rod in tension.

17. The method of claim 16, further comprising:

encasing the first tie rod within a first tube; and placing the first tube in compression.

18. The method of claim 17, further comprising:

monitoring the deflection in the work surface of the one press member to which the first tie rod is connected; and altering the tension in the first tie rod and thereby correspondingly altering the compression in said first tube based upon the monitored deflection in the work surface of the one press member to which the first tie rod is connected.

19. The method of claim 17, further comprising:

connecting a second tie rod to another press member including only the other of the slide or the bed of the press; and placing the second tie rod in tension.

20. The method of claim 19, further comprising:

encasing the second tie rod within a second tube; and placing the second tube in compression.

21. The method of claim 20 further comprising:

monitoring the deflection in the work surface of another press member to which the second tie rod is connected; and altering the tension in the second tie rod and thereby correspondingly altering the compression in said second tube based upon the monitored deflection in the work surface of another press member to which the second tie rod is connected.

22. A press system, comprising:

a press member having a worksurface; and a means for adjusting a deflection of said worksurface in a manner directed to minimizing the worksurface deflection.

23. The press system as recited in claim 22, further comprises:

a measurement device, operatively associated with said adjusting means, to provide a measure of worksurface deflection.

24. The press system as recited in claim 22, wherein said press member includes at least one of a slide and a bed.

25. A press system, comprising:

a press member having a worksurface;

a measurement device to provide a measure of worksurface deflection; and a means, responsive to the worksurface deflection measurement, for adjusting the deflection of said worksurface to effect minimization thereof.

26.The press system as recited in claim 25, wherein said press member includes at least one of a slide and a bed.

27. A press system, comprising:

a press member having a worksurface; and a means for minimizing a deflection of said worksurface.

28. The press system as recited in claim 27, further comprises:

a measurement device, operatively associated with said minimizing means, to provide a measure of worksurface deflection.

29. The press system as recited in claim 27, wherein said press member includes at least one of a slide and a bed.

30. The press system as recited in claim 27, wherein the minimization of worksurface deflection by said minimizing means being performed dynamically during press operation.

* * * * *